US010548448B2

(12) United States Patent
Ebrahimi Afrouzi

(10) Patent No.: US 10,548,448 B2
(45) Date of Patent: Feb. 4, 2020

(54) MODULAR ROBOTIC FLOOR-CLEANING SYSTEM

(71) Applicant: Ali Ebrahimi Afrouzi, San Jose, CA (US)

(72) Inventor: Ali Ebrahimi Afrouzi, San Jose, CA (US)

(73) Assignee: AI Incorporated, Toronto (CA)

( * ) Notice: Subject to any disclaimer, the term of this patent is extended or adjusted under 35 U.S.C. 154(b) by 160 days.

(21) Appl. No.: 14/997,801

(22) Filed: Jan. 18, 2016

(65) Prior Publication Data

US 2016/0227975 A1 Aug. 11, 2016

Related U.S. Application Data

(60) Provisional application No. 62/114,569, filed on Feb. 10, 2015.

(51) Int. Cl.
*A47L 11/40* (2006.01)

(52) U.S. Cl.
CPC ..... *A47L 11/4013* (2013.01); *A47L 11/4011* (2013.01); *A47L 11/4066* (2013.01); *A47L 2201/024* (2013.01)

(58) Field of Classification Search
CPC ..... A47L 11/4013; A47L 11/4011; A47L 11/4066; A47L 2201/024; A47L 11/4025; A47L 11/408; A47L 2201/02; A47L 9/2842; A47L 9/2857; A47L 2201/00; A47L 9/2889; A47L 9/2805; A47L 11/24; A47L 5/00; E01H 1/08
See application file for complete search history.

(56) References Cited

U.S. PATENT DOCUMENTS

2006/0060216 A1* 3/2006 Woo ..... A47L 9/0009 134/18
2007/0050937 A1* 3/2007 Song ..... A47L 5/225 15/319
2007/0245511 A1* 10/2007 Hahm ..... A47L 9/106 15/319
2008/0052846 A1* 3/2008 Kapoor ..... A47L 9/106 15/52.1
2008/0282494 A1* 11/2008 Won ..... A47L 5/30 15/319
2009/0044370 A1* 2/2009 Won ..... A47L 9/106 15/319

* cited by examiner

*Primary Examiner* — Robert J Scruggs

(57) ABSTRACT

A floor-cleaning system comprised of a mobile robot having compartments to hold modules corresponding to various functions and a base station storing extra modules. The mobile robot runs until one or more modules is expended, at which point the robot navigates to the base station, ejects expended modules, and loads new modules. The robot continues operation with a minimum amount of downtime and a reduced need for human intervention. The base station may be supplied with numerous ready modules so that a human administrator only needs to replenish, replace or empty the modules periodically.

8 Claims, 4 Drawing Sheets

MODULAR ROBOTIC FLOOR-CLEANING SYSTEM

CROSS-REFERENCE TO RELATED APPLICATIONS

This application claims the benefit of provisional patent application Ser. No. 62/114,569, filed Feb. 10, 2015 by the present inventor.

FIELD OF INVENTION

The present invention relates to automated floor-cleaning systems.

BACKGROUND OF INVENTION

The following is a tabulation of some prior art that presently appears relevant:

U.S. Patent Documents

| Pat. No. | Kind Code | Issue Date | Patentee |
|---|---|---|---|
| 4,829,840 | A | 1989 May 16 | FANUC LTD., et al. |
| 7,013,527 | B2 | 2006 Mar. 21 | Diversey Inc |
| 6,741,054 | B2 | 2004 May 25 | Vision Robotics Corp |
| 7,937,800 | B2 | 2011 May 10 | Jason Yan |
| 8,671,507 | B2 | 2010 Jun. 28 | iRobot Corp |
| 6,883,201 | B2 | 2005 Apr. 26 | iRobot Corp |
| 7,474,941 | B2 | 2009 Jan. 6 | Samsung Electronics Co Ltd |
| 8,209,053 | B2 | 2012 Jun. 26 | Samsung Electronics Co Ltd |

Robotic appliances have become increasingly popular for cleaning residential homes. Vacuuming and mopping robots are frequently used to clean floors. These devices, however, are not widely used in commercial settings. One reason for this is that robotic appliances often require servicing (emptying of debris, replacement of cleaning liquid) too frequently to be practical for cleaning very large areas. A need exists for a method to allow a mobile robotic cleaning device to operate for longer periods of time and cover larger spaces without requiring frequent maintenance.

SUMMARY OF INVENTION

It is a goal of the present invention to provide a robotic floor-cleaning system that requires a minimal amount of maintenance.

It is a goal of the present invention to provide a robotic floor-cleaning system that can operate for extended periods of time and cover large amounts of surface area with a minimum of stoppages.

It is a goal of the present invention to provide a robotic floor-cleaning system that can effectively service large scale or commercial locations.

The present invention achieves the aforementioned goals through a modular robotic floor-cleaning system. A mobile cleaning robot has modules for each of its functions that use resources or collect materials utilizing fluids and or liquids on a work surface. For example, a mopping module, water module, a cleaning fluid module, a polishing module and battery module may be provided. A separate base station stores new modules, so that when modules are expended, they may be exchanged for new modules. For example, once the cleaning fluid module is empty, the robot returns to the base station and exchanges the empty cleaning fluid module for a full module.

DETAILED DESCRIPTION OF THE INVENTION

The present invention will now be described in detail with reference to a few embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

Generally, the present invention relates to a modular robotic floor-cleaning system suitable for cleaning large spaces.

A floor-cleaning robot has modules for each of its functions that collect or consume resources. The modules may be ejected and replaced as necessary. A synchronized base station stores new modules and, in some embodiments, may also contain a repository for used modules. Periodically, the robot returns to the base station, ejects expended modules, and loads new modules. In some embodiments, exchange of modules may be triggered by sensors that detect when a module has been expended. In some embodiments, exchange of modules may simply occur at predetermined intervals based on the run time of the system. The system can thus continue working without waiting for human assistance in emptying, cleaning, or refilling modules.

Figure 1A:
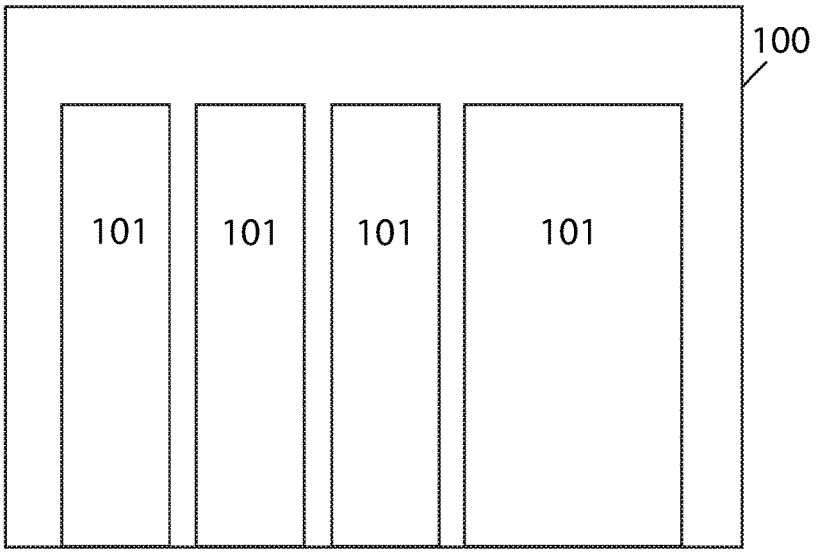
FIG. 1A illustrates an overhead view of a floor-cleaning robot embodying features of the present invention.

Referring to FIG. 1A, an overhead view of a floor-cleaning robot 100 is illustrated. In the example shown, the robot has four modules 101. It should be noted that any number of modules for holding fluids, liquids or for a rechargeable battery may be provided without departing from the scope of the invention; the example shown is meant to be illustrative, rather than restrictive. Modules may have different functions related to the system capabilities. For example, a floor-cleaning robot may contain a cleaning fluid tank module where cleaning fluid for mopping the floor is stored, a water tank module where water for steaming the floor is stored, a polishing module where wax or another polishing agent for polishing a floor is stored, and a battery module where a battery for supplying power to the system is stored. Other types of modules for holding fluids or liquids may be provided without limitation; these examples are meant to be illustrative.

Figure 1B:
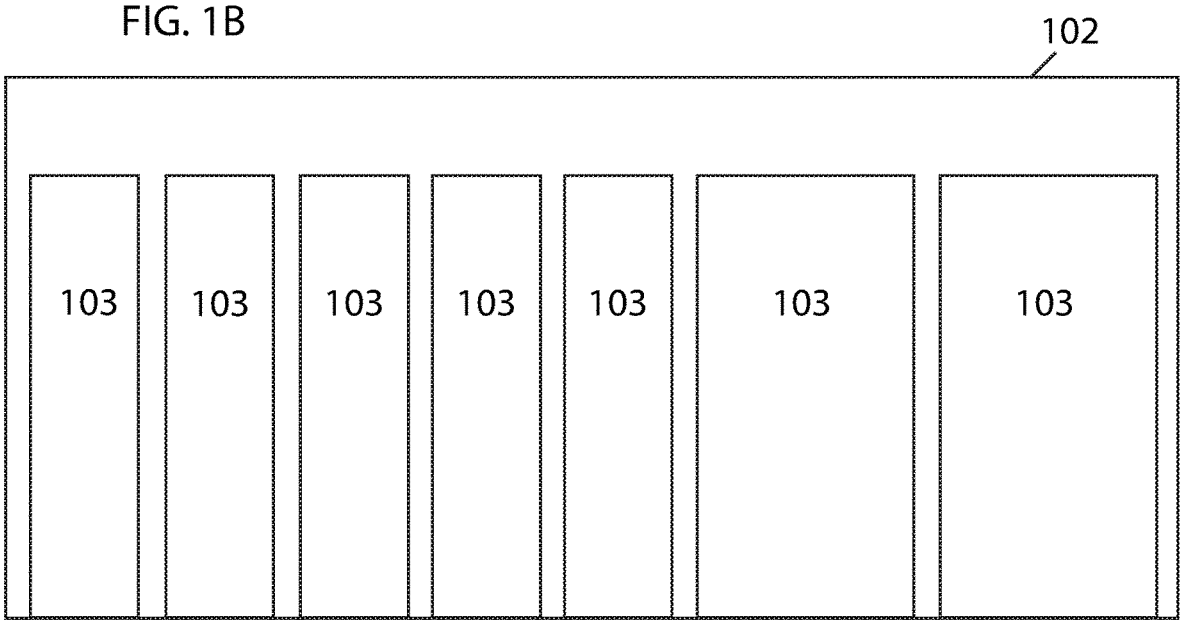
FIG. 1B illustrates an overhead view of a base station containing extra modules embodying features of the present invention.

Referring to FIG. 1B, a base station 102 storing extra unused modules 103 is illustrated. A base station is not limited in size and may contain any number of modules without limitation.

Figure 2:
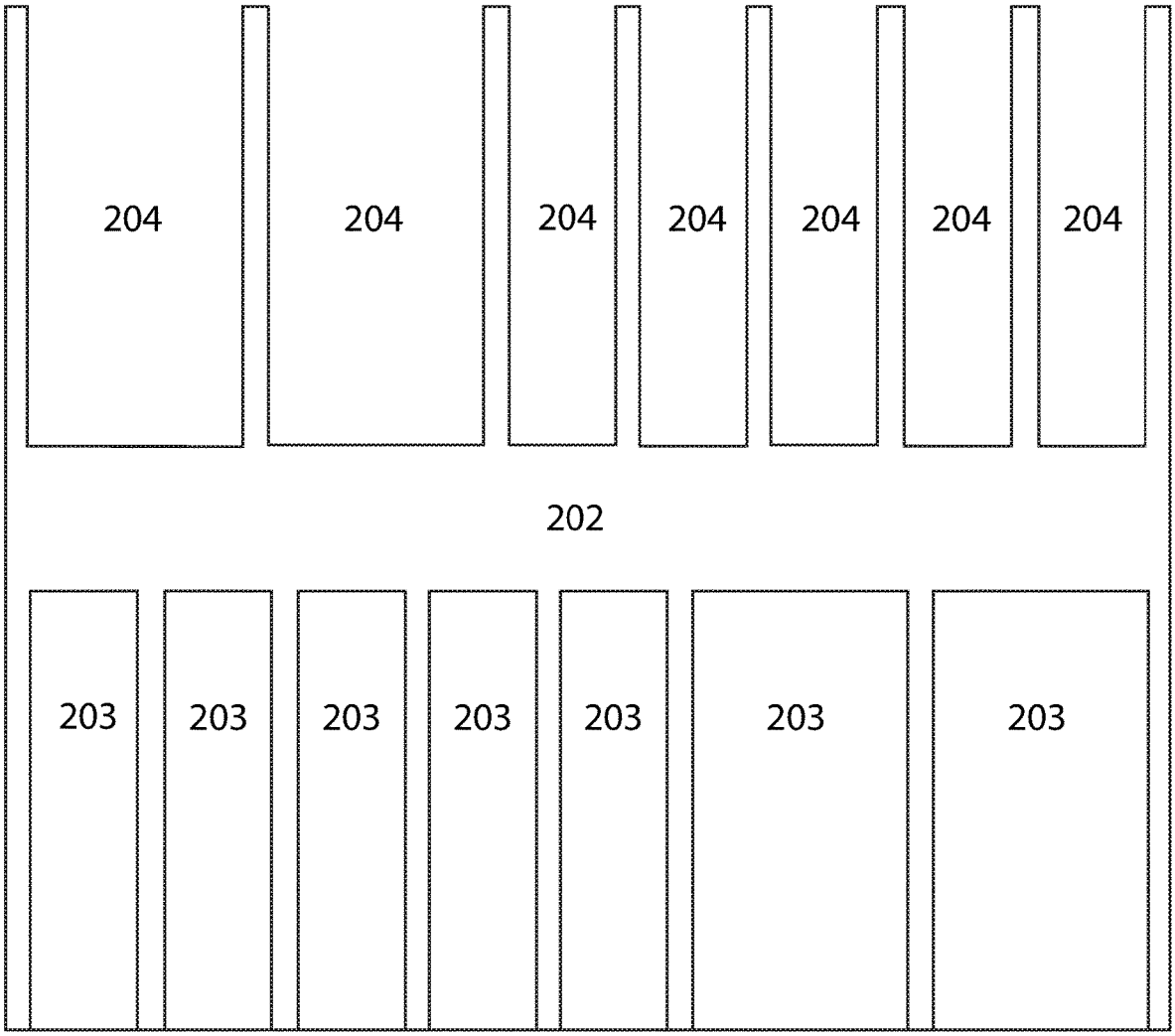
FIG. 2 illustrates an overhead view of a base station containing extra modules and a repository for storing used modules embodying features of the present invention.

In some embodiments, the base station further comprises a repository for storing ejected/expended modules. Referring to FIG. 2, a base station 202 is illustrated. The base station comprises extra unused modules 203 and also has an area where used modules may be received. Used modules may be ejected into the empty slots 204.

The floor-cleaning robot carries out operation as normal until it reaches any of a predetermined time limit, a predetermined stopping point, or a sensed state.

Figure 3:
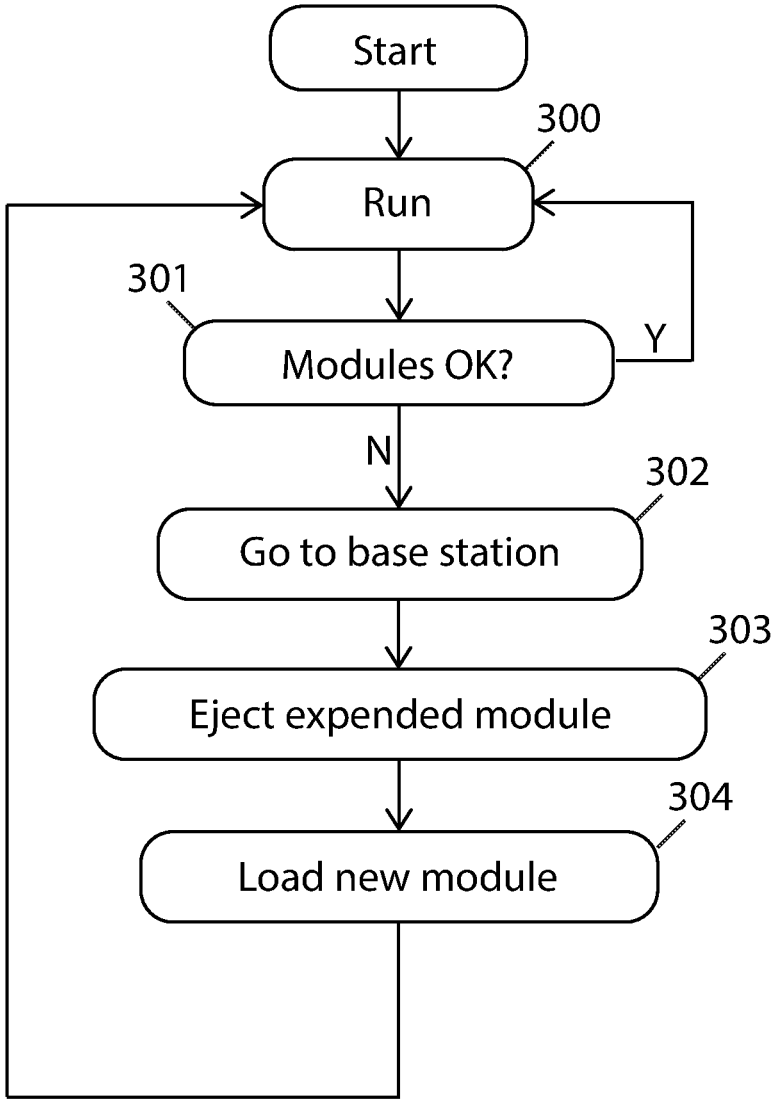
FIG. 3 illustrates the process of a floor-cleaning robot exchanging a used module for a new module embodying features of the present invention.

Referring to FIG. 3, the process of exchanging modules during operation is illustrated. In a first step 300, the floor-cleaning robot operates using the modules positioned within the body of the device. In a next step 301, the system determines whether any module has been expended. In some embodiments, sensors positioned adjacent to or within modules detect when a module is expended. In cleaning fluid tank modules, water tank modules, and polishing modules, a sensor may detect when the module is empty. In a battery module, a voltmeter may detect when the battery is discharged. In some embodiments, a timer indicates that modules are expended after a predetermined amount of running time. In some embodiments, a user may provide input instructing the system that a module is expended. If no modules are expended, the device continues work normally. Upon detection that one or more modules has been expended, the method proceeds to a next step 302 to navigate to the base station. In some embodiments, the system may be provided with mapping technology by which the robot may localize itself and the base station within a map of the environment and navigate to the base station. In some embodiments, the floor-cleaning robot uses sensors to detect and navigate to the base station. The specific methods for navigating to the base station are not part of the scope of the invention, so a detailed description thereof is not provided. In a next step 303, the expended module or modules are ejected from the robot. Numerous methods for ejecting units from devices exist and are used across many fields; any available method may be used to eject the module from the robot. Specific methods for ejecting modules from the robot are not part of the scope of the invention, therefore a detailed description thereof is not provided. In a next step 304, a new module to replace the ejected module is loaded from the base station into the floor-cleaning robot. Numerous methods for loading units into devices exist and are used across many fields; any available method may be used to load the module into the robot. Specific methods for loading modules into the robot are not part of the scope of the invention, therefore a detailed description thereof is not provided. The system continues operation as normal.

Figure 4:
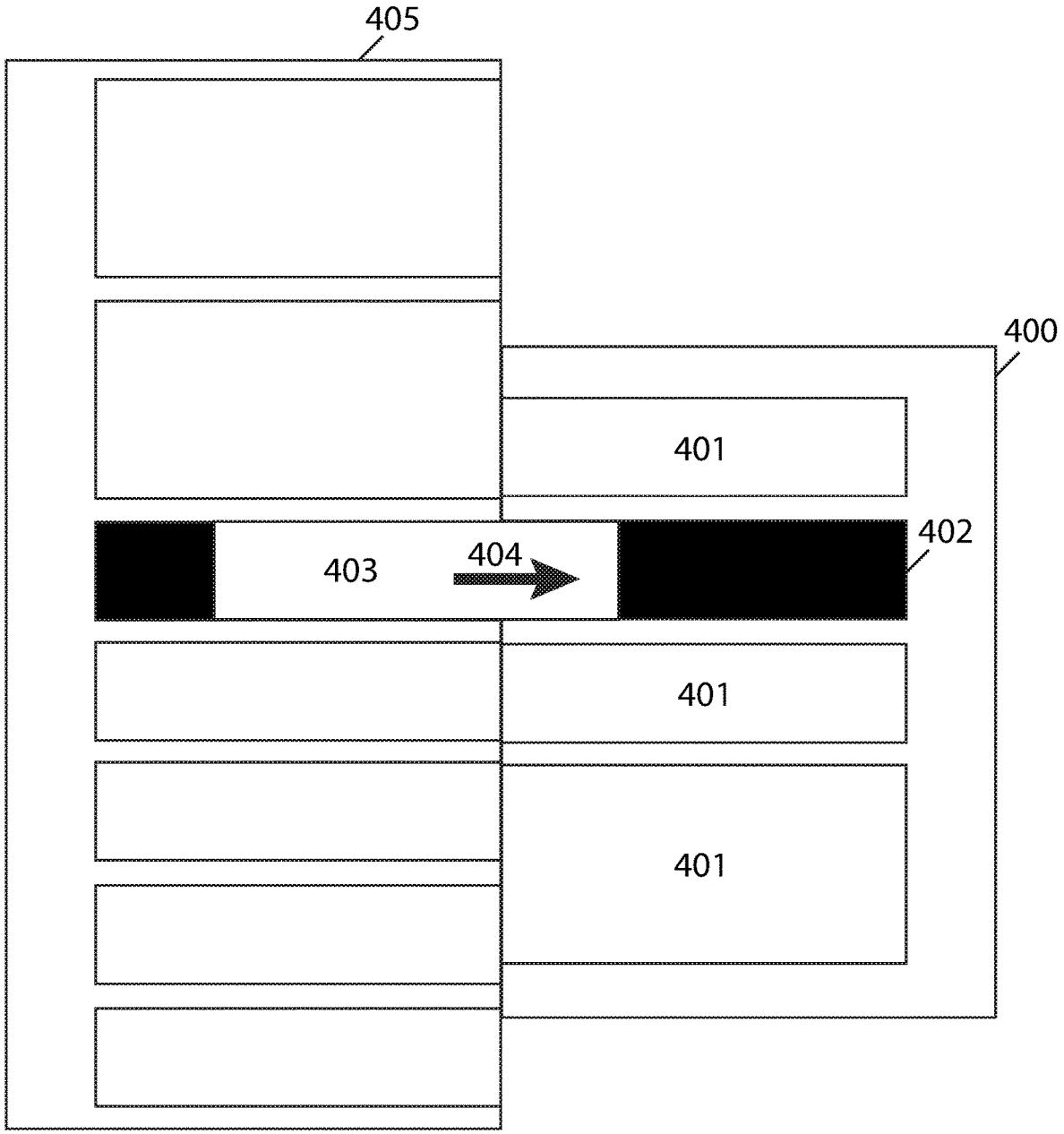
FIG. 4 illustrates a floor-cleaning robot loading a new module from a base station embodying features of the present invention.

Referring to FIG. 4, the loading of a module from a base station into a robot is illustrated. The robot 400 contains three modules 401 and has one open slot 402. The robot aligns the open slot 402 with the module 403 in the base station 405 that is to be loaded into the open slot. Any method for aligning the robot with the target may be used. Methods for alignment are widely used in the field and are not part of the scope of the invention, therefore a detailed description thereof is not provided. Once the slot is correctly aligned, the new module 403 may be loaded from the base station into the robot. The module is moved in a direction 404 into the slot 402. When the module is fully loaded into the slot, the robot may continue operation as normal.

In some embodiments, a single base station may serve groups of floor-cleaning robots. A base station containing modules for all the floor-cleaning robots in a group may be positioned in a central location where all the robots in the group may access it to load new modules as needed.

I claim:

1. A modular floor-cleaning system comprising a mobile robot and a base station, the mobile robot comprising:

a chassis;

a drive system installed in the chassis operable to enable movement of the robot, the drive system comprising a set of wheels;

a control system in communication with the drive system including a processor operable to control the drive system to provide at least one movement pattern;

a cleaning assembly;

two or more slots, each slot capable of separately holding an entire removable module, said removable module including one of the following; a module for holding a battery; a module for storing water; a module for storing cleaning fluid; a module for storing mopping fluid, and a module for storing a polishing agent;

means for loading and ejecting modules; and means for navigating to the base station;

the base station comprising a first repository for one or more new modules corresponding to system functions and a second repository for one or more used modules, whereby the mobile robot is operable to periodically eject used modules into the second repository of the base station and load new modules from the first repository of the base station into one or more open slots of the mobile robot.

2. The system of claim 1 wherein the mobile robot exchanges said one or more used modules holding a battery, storing water, storing cleaning fluid, storing mopping fluid, or storing a polishing agent when said one or more used modules are depleted.

3. The system of claim 1 further comprising sensors in communication with the processor and positioned within each said one or more modules that detect when the one or more modules have been expended, detection of the one or more expended modules triggering the mobile robot to return to the base station, eject the one or more expended modules into the second repository of the base station, and load the one or more new modules from the first repository of the base station into the one or more open slots of the mobile robot.

4. The system of claim 1 wherein exchange of said one or more used modules for said one or more new modules occurs at predetermined intervals based on the run time of the mobile robot wherein at predetermined intervals the mobile robot returns to the base station, ejects the one or more used modules into the second repository of the base station, and loads the one or more new modules from the first repository of the base station into the one or more open slots of the mobile robot.

5. The system of claim 1 further comprising sensors in communication with the processor and positioned adjacent to each said one or more modules that detect when the one or more modules have been expended, detection of the one or more expended modules triggering the mobile robot to return to the base station, eject the one or more expended modules into the second repository of the base station, and load the one or more new modules from the first repository of the base station into the one or more open slots of the mobile robot.

6. The system of claim 1 further comprising sensors in communication with the processor that detect when the one or more modules have been expended, detection of the one or more expended modules triggering the mobile robot to return to the base station, eject the one or more expended modules into the second repository of the base station, and load the one or more new modules from the first repository of the base station into the one or more open slots of the mobile robot.

7. The system of claim 1 wherein the mobile robot comprises a means for aligning the one or more slots with the first and second repository of the base station.

8. The system of claim 1 wherein the mobile robot operates until one or more of the following is reached: a predetermined time limit, a predetermined position, and a predetermined sensed state.

* * * * *